US005573234A

United States Patent [19]

Petocchi

[11] Patent Number: 5,573,234

[45] Date of Patent: Nov. 12, 1996

[54] DUAL MODE SHEET FEEDER

[75] Inventor: Ermanno C. Petocchi, Rochester, N.Y.

[73] Assignee: Xerox Corporation, Stamford, Conn.

[21] Appl. No.: 344,058

[22] Filed: Nov. 23, 1994

[51] Int. Cl.[6] ..... B65H 3/44

[52] U.S. Cl. ..... 271/9.01; 271/9.12; 271/171; 271/127

[58] Field of Search ..... 271/9.01, 9.12, 271/127, 171

[56] References Cited

U.S. PATENT DOCUMENTS

| | | | |
|---|---|---|---|
| 5,076,562 | 12/1991 | Sai et al. | 271/9 |
| 5,096,181 | 3/1992 | Menon et al. | 271/157 |
| 5,102,112 | 4/1992 | Takahashi | 271/9 |
| 5,221,951 | 6/1993 | Sakamoto | 271/9.12 |

FOREIGN PATENT DOCUMENTS

| | | | |
|---|---|---|---|
| 2061231 | 5/1981 | Japan | 271/127 |
| 59-097936 | 6/1984 | Japan | 271/171 |
| 2204237 | 8/1990 | Japan | 271/9.12 |
| 4016430 | 1/1992 | Japan | 271/9.12 |
| 5286581 | 11/1993 | Japan | 271/9.12 |

OTHER PUBLICATIONS

Xerox Disclosure Journal, vol. 9, No. 2, Mar./Apr. 1984, Author: Jack R. Oagley Title: Load While Run Copy Handling Module.

*Primary Examiner*—H. Grant Skaggs
*Attorney, Agent, or Firm*—H. Fleischer; J. E. Beck; R Zibelli

[57] ABSTRACT

An apparatus which advances sheets from different stacks of sheets. In one mode of operation, two stacks of sheets are supported side by side. A sheet feeder associated with each stack of sheets advances successive uppermost sheets from the respective stack to a transfer station of a printing machine. Alternatively, a single sheet feeder mounted movably in the sheet feeding apparatus may be employed to advance successive sheets from each of the stack of sheets, in lieu two sheet feeders. In the absence of these stacks of sheets, another oversized stack of sheets may be positioned in the sheet feeder. This oversized stack of sheets extends from a first sheet storing section into a second sheet storing section. When two stacks of sheets are disposed in the sheet feeder, one stack is positioned in the first sheet storing section and the other stack is positioned in the second sheet storing section. In this way, the sheet feeding apparatus has capability of feeding multiple size sheets.

16 Claims, 2 Drawing Sheets

DUAL MODE SHEET FEEDER

This invention relates generally to sheet feeding, and more particularly concerns a sheet feeding apparatus which has the capability of feeding and storing two stacks of sheets side by side or one oversized stack of sheets.

An electrophotographic printing machine is frequently utilized in various environments ranging from a relatively low volume office use to a high volume use. In either case, it is desirable to be capable of feeding multiple size sheets to the transfer station of an electrophotographic printing machine. To achieve this, printing machines frequently utilize sheet feeders having multiple trays. Each tray may hold a different size stack of sheets thereon. Alternatively, each of the trays may hold the same size stack of sheets thereon in order to increase the capacity of the sheet feeder. Frequently, the stacks of sheets were arranged vertically which increased the overall height of the printing machine. Multiple trays permit large capacity sheet feeding systems or, in the alternative, enable the sheet feeding system to feed variable size sheets. A sheet feeding system of this type also permits the loading of additional stacks of sheets while the printing machine continues to run. Thus, sheets may be fed from one stack of sheets while the operator loads the other tray with a new stack of sheets. This provides the machine with the capability of running continuously.

In order to reduce cost and size, it has been found that sheet trays may be positioned side by side rather than arranged vertically. Sheet feeding systems of this type employ two sheet feeders for advancing sheets from the respective stack to the transfer station of the printing machine. The overall height of the printing machine is reduced inasmuch as the stacks of sheets are arranged horizontally rather than vertically.

Various types of sheet feeding system have hereinbefore been used as illustrated by the following disclosures, which may be relevant to certain aspects of the present invention:

Xerox Disclosure Journal

Volume 9, No. 2, March/April 1984

Author: Oagley

Page 113

U.S. Pat. No. 5,076,562

Patentee: Sai et al.

Issued: Dec. 31, 1991

U.S. Pat. No. 5,096,181

Patentee: Menon et al.

Issued: Mar. 17, 1992

U.S. Pat. No. 5,102,112

Patentee: Takahasi

Issued; Apr. 7, 1992

The relevant portions of the foregoing disclosures may be briefly summarized as follows:

The Xerox Disclosure Journal article shows an auxiliary sheet tray having a sheet feeder associated therewith and a main sheet tray having another sheet feeder associated therewith. Stacks of sheets are positioned on both the main tray and the auxiliary tray. These trays are arranged vertically with one being above the other.

U.S. Pat. No. 5,076,562 discloses two stacks of sheets arranged side by side. A single sheet feeder is located over one of the stacks of sheets. After the stack of sheets operatively associated with the sheet feeder, is depleted the other stack of sheets moves into an operative position with respect the sheet feeder.

U.S. Pat. No. 5,096,181 is a sheet feeder fixed with respect to a stack of sheets. After the stack of sheets is depleted, another stack of sheets is moved into an operative relationship with the sheets feeder. The stacks of sheets are arranged side by side.

U.S. Pat. No. 5,102,112 describes a printing machine having a stack of sheets disposed therein. A roller advances successive sheets from the stack. An auxiliary sheet feeder is provided. The auxiliary sheet feeder has three stacks of sheets disposed therein. Two of the stacks of sheets are arranged side by side on a tray. A sheet feeder is positioned over one of the stacks of sheets. After the sheets in that stack are depleted, the other stack of sheets is positioned in an operative relationship with the sheet feeder. A third, stack of larger sheets, is located vertically beneath the two stacks of sheets disposed side by side. Another sheet feeder is associated with the third stack of sheets to advance the larger sheets to the printing machine.

In accordance with one aspect of the present invention, there is provided an apparatus for feeding sheet material. The apparatus includes a tray having a first sheet storing section and a second sheet storing section. The tray is adapted to support a first stack of sheet material in the first sheet storing section and a second stack of sheet material in the second sheet storing section. In the absence of the first stack of sheet material and the second stack of sheet material, a third stack of sheet material is positioned in the first sheet storing section with at least a portion thereof overlapping into the second sheet storing section. A first sheet feeder is adapted to be operatively associated with the first stack of sheet material or the third stack of sheet material disposed in the first sheets storing section of the tray. The first sheet feeder is in an non-operative relationship with the second stack of sheet material disposed in the second sheet storing section of the tray. A second sheet feeder is adapted to be operatively associated with the second stack of sheet material disposed in the second sheet storing section of the tray. The second sheet feeder in a nonoperative relationship with the first stack of sheet material and the third stack of sheet material.

Pursuant to another aspect of the present invention, there is provided an apparatus for feeding sheet material. The apparatus includes a tray having a first sheet storing section and a second sheet storing section. The tray is adapted to support a first stack of sheet material in the first sheet storing section and a second stack of sheet material in the second sheet storing section. In the absence of the first stack of sheet material and the second stack of sheet material, a third stack of sheet material is positioned in the first sheet storing section with at least a portion thereof overlapping into the second sheet storing section. A movable sheet feeder is adapted to move between a first position operatively associated with the first stack of sheet material or third stack of sheet material, and a second position, operatively associated with the second stack of sheet material.

Still another aspect of the present invention is a printing machine of the type in which a sheet advances to a transfer station for receiving a visible image thereat. The improvement includes a tray having a first sheet storing section and a second sheet storing section. The tray is adapted to support a first stack of sheet material in the first sheet storing section and a second stack of sheet material in the second sheet storing section. In the absence of the first stack of sheet material and the second stack of sheet material, a third stack of sheet material is positioned in the first sheet storing section with at least a portion thereof overlapping into the second sheet storing section. A first sheet feeder is adapted to be operatively associated with the first stack of sheet material or the third stack of sheet material disposed in the first sheet storing section of the tray. The first sheet feeder is in a non-operative relationship with the second stack of sheet material disposed in the second sheet storing position of the tray. The first sheet feeder is adapted to advance successive outermost sheets from the first stack of sheet material or the third stack of sheet material to the transfer station. A second sheet feeder is adapted to be operatively associated with the second stack of sheet material disposed in the second sheet storing section of the tray. The second sheet feeder is in a non-operative relationship with the first stack of sheet material and the third stack of sheet material. The second sheet feeder is adapted to advance successive outermost sheets from the second stack of sheet material to the transfer station.

In another aspect of the present invention, a printing machine advances a sheet to a transfer station for receiving a visible image thereat. The improvement includes a tray having a first sheet storing section and a second sheet storing section. The tray is adapted to support a first stack of sheet material in the first sheet storing section and a second stack of sheet material in the second sheet storing section. In the absence of the first stack of sheet material and the second stack of sheet material, a third stack of sheet material is positioned in the first sheet storing section with at least a portion thereof overlapping into the second sheet storing section. A movable sheet feeder is adapted to move between a first position operatively associated with the first stack of sheet material or the third stack of sheet material and a second position operatively associated with the second stack of sheet material. The sheet feeder is adapted to advance sheets from the first, second or third stacks of sheet material to the transfer station.

All the features of the present invention will become apparent as the following description proceeds and upon reference to the drawings, in which.

While the present invention will be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 4 printing machine will be shown hereinafter schematically and their operation described briefly with reference thereto.

Figure 4:
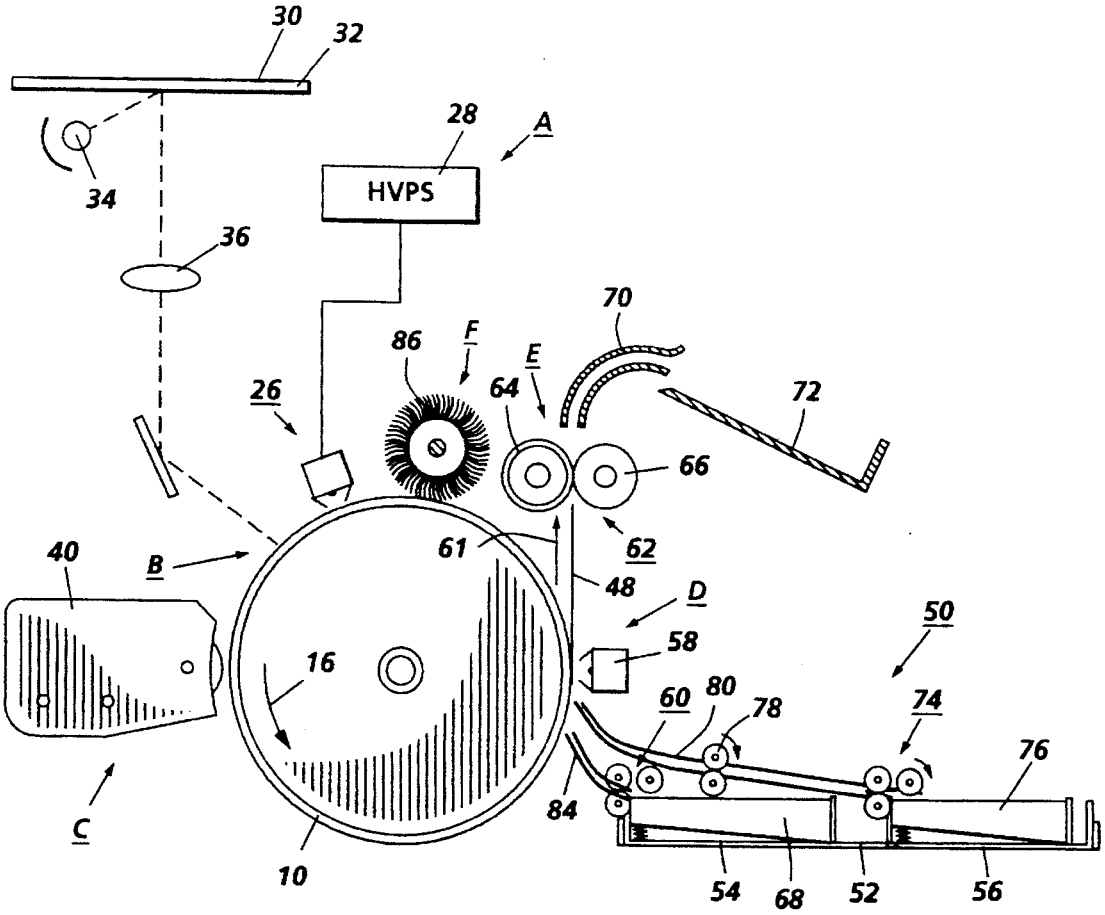
FIG. 4 is a schematic elevational view of an illustrative electrophotographic printing machine incorporating the sheet feeding apparatus of the present invention therein.

Referring initially to FIG. 4, there is shown an illustrative electrophotographic printing machine using a drum 10 having a photoconductive surface deposited on an electrically grounded conductive substrate. One skilled in the art will appreciate that any suitable photoconductive material may be used. Drum 10 rotates in the direction of arrow 16 to advance successive portions of the photoconductive surface sequentially through the various processing stations disposed about the path of movement thereof. Initially, a portion of drum 10 passes through charging station A. At charging station A, a corona generating device, indicated generally by the reference numeral 26, charges the photoconductive surface of drum 10 to a relatively high, substantially uniform potential. High voltage power supply 28 is coupled to corona generating device 26. Excitation of power supply 28 causes corona generating device 26 to charge the photoconductive surface of drum 10. After the photoconductive surface of drum 10 is charged, the charged portion thereof is advanced through exposure station B.

At exposure station B, an original document 30 is placed face down on a transparent platen 32. Lamps 34 flash light rays onto original document 30. The light rays reflected from original document 30 are transmitted through lens 36 to form a light image thereof. Lens 36 focuses the light image onto the charge portion of the photoconductive surface to selectively dissipate the charge thereon. This records an electrostatic latent image on the photoconductive surface which corresponds to the informational areas contained within original document 30. Alternatively, a raster output scanner may be used in lieu of the light lens system previously described to layout an image in a series of horizontal scan lines with each line having a specified number of pixels per inch. Typically, a raster output scanner includes a laser with a polygon mirror block and a modulator.

After the electrostatic latent image has been recorded on the photoconductive surface, drum 10 advances the latent image to development station C. At development station C, a developer unit, indicated generally by the reference numeral 40 develops the latent image recorded on the photoconductive surface with toner.

With continued reference to FIG. 4, after the electrostatic latent image is developed, drum 10 advances the toner powder image to transfer station D. A copy sheet 48 is advanced to transfer station D by sheet feeding apparatus 50. Sheet feeding apparatus 50 includes a support tray 52 having a first sheet storing section 54 and a second sheet storing section 56. A first sheet feeder indicated generally by the reference numeral 60 is associated with stack 68 disposed in section 54. A second sheet feeder, indicated generally by the reference numeral 74, is associated with stack 76 disposed in section 56. When sheets are advanced by sheet feeder 74 from stack 76, forwarding rollers 78 guide the sheet through chute 80 to transfer station D. Alternatively, when sheet feeder 60 advances sheets from stack 68, the sheets move through chute 84 to transfer station D. The details of the embodiments of sheet feeding apparatus 50 will be discussed hereinafter with reference FIGS. 1 through 3, inclusive.

The advancing sheet moves into contact with the photoconductive surface of drum 10 in a timed sequence so that the toner powder image developed thereon contacts the sheet at transfer station D. Transfer station D includes a corona generating device 58 which sprays ions onto the backside of sheet 48. This attracts the toner powder image from the photoconductive surface to sheet 48. After transfer, sheet 48 continues to move in the direction of arrow 61 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and backup roller 66 with the toner powder image contacting fuser roller 64. In this manner, the toner powder image is permanently affixed to sheet 48. After fusing, sheet 48 advances to catch tray 72 for subsequent removal from the printing machine by the operator.

After the copy sheet is separated from the photoconductive surface of drum 10, the residual toner particles adhering to the photoconductive surface are removed therefrom at cleaning station F. Cleaning station F includes a rotatably mounted fibrous brush 86 in contact with the photoconductive surface of drum 10. The particles are cleaned from the photoconductive surface by the rotation of brush 86 in contact therewith. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the sheet feeding apparatus of the present invention therein.

Figure 1:
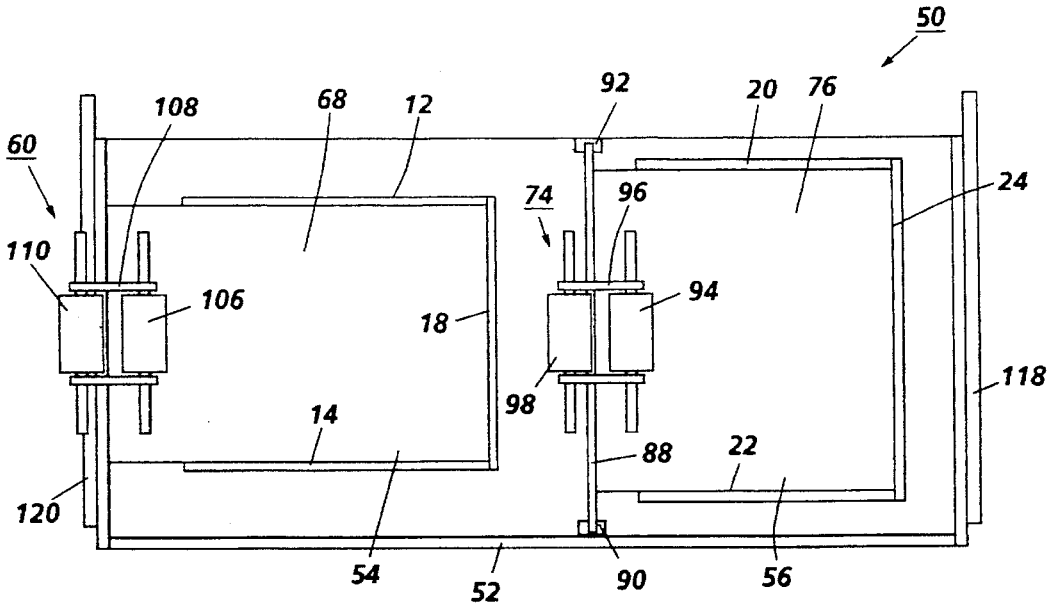
FIG. 1 is a plan view of a sheet feeding apparatus incorporating the features of the present invention therein.
Figure 2:
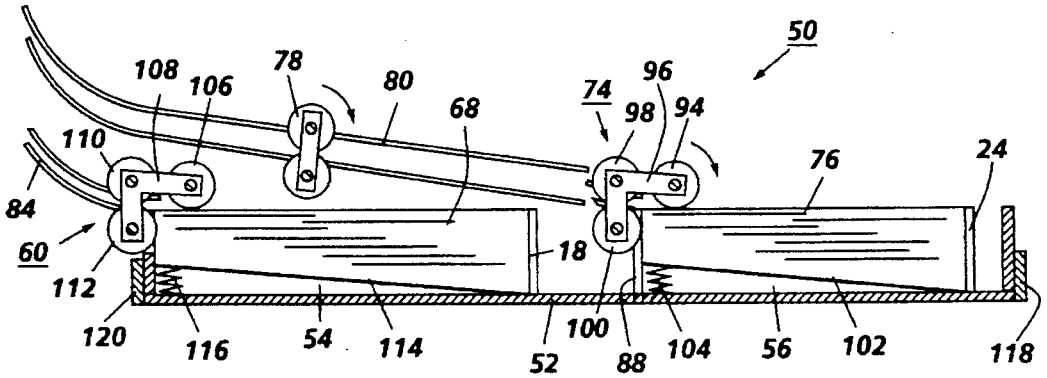
FIG. 2 is an elevational view of the FIG. 1 sheet feeding apparatus.

Referring initially to FIGS. 1 and 2, there is shown sheet feeding apparatus 50 having two stacks of sheets disposed therein. As shown in FIGS. 1 and 2, sheet feeding apparatus 50 has stack 68 in a first sheet storing section 54 of tray 52. A second stack of sheets 76 is disposed in a second sheet storing section 56 of tray 52. Sheet feeder 60 is associated with stack 68, while sheet feeder 74 is associated with stack 76. Sheet feeder 74 is mounted on registration plate 88. The lead edge of the stack of sheets 76 engages registration plate 88. Registration plate 88 is mounted removably in sheet feeder 50. Registration plate 88 is mounted in slots 90 and 92 in the side walls of sheet feeding apparatus 50. Thus, removal of registration plate 88 also removes sheet feeder 74 from sheet feeding apparatus 50. Sheet feeder 74 includes a feed roll 94 mounted in a bracket 96 which pivots to position feed roll 94 in contact with the uppermost sheet of stack 76. Rolls 98 and 100 are also mounted in bracket 96 and form a nip through which the advancing sheet passes. This prevents feeding of multiple sheets from stack 76. After the lead ledge of the sheet passes through the nip defined by rolls 98 and 100, it enters chute 80. Chute 80 guides the advancing sheet into the nip defined by rolls 78. Rolls 78 continue to advance the sheet to transfer station D. Stack 76 is positioned on a pivotably mounted base plate 102. A spring 104 resiliently urges plate 102 to pivot in an upwardly direction so as to continuously position the uppermost sheet of stack 76 in contact roll 94. Sheet feeder 60 is constructed in a similar fashion to that of sheet feeder 74. A feed roll 106 is mounted rotatably on bracket 108. Bracket 108 pivots to position feed roll 106 in contact with the uppermost sheet of stack 68. Rolls 110 and 112 are also mounted on bracket 108 and define a nip through which the advancing sheet passes. This nip prevents multiple sheet feeds. The advancing sheet passes into chute 84 which guides it to transfer station D. Stack 68 is supported on base plate 114. Base plate 114 is mounted pivotably in tray 52. A spring 116 resiliently urges base plate 114 to pivot in an upwardly direction so as to position the uppermost sheets of stack 68 continuously in contact with feed roll 106. The entire sheet feeding apparatus 50 is mounted slidably in the printing machine. This achieved by having support tray 52 mounted slidably in frames 118 and 120 of the printing machine. Thus, support tray 52 may be removed from the printing machine and additional stacks of paper loaded in sheet feeding apparatus 50. Side plates 12 and 14 are mounted in slots in base plate 114 so as to be adjustable for varying width stacks of sheets. Similarly, back plate 18 is mounted slidably and removably on base plate 114 to adjust for differing length stacks of sheets, as well as to be removable therefrom when an oversized stack of sheets is disposed in the printing machine. Thus, back plate 18 is mounted in slots in base plate 114 and is operator removable. In a similar fashion, side plates 20 and 22 are mounted slidably on base plate 102 so as to adjust for different width stacks of sheets. Back plate 24 is mounted slidably on base plate 102 so as to be adjustable for different widths of stacks of sheets disposed thereon.

Figure 3:
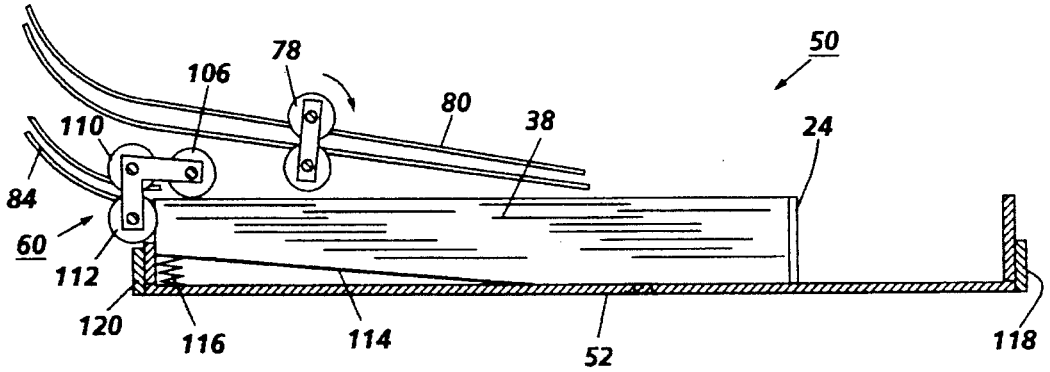
FIG. 3 is an elevational of the FIG. 1 sheet feeding apparatus showing an oversized stack of sheets disposed therein.

FIG. 3 depicts an oversized stack of sheets 38 disposed in sheet feeding apparatus 50. As shown thereat, sheet feeder 74 is removed from the sheet feeding apparatus. Similarly, back plate 18 is also removed. Back plate 24 is adjusted to engage the trailing edge of the stack of sheets 38. The stack of sheets 38 is of a size such that a portion thereof extends from the first sheet storing section 54 into the second sheet storing section 56. Thus, the stack of sheets 38 overlaps into the second sheet storing section 56 from the first sheet storing section 54. Under these circumstances, the sheet feeder 74 associated with the stack of sheets in the sheet storing section 56 is removed to facilitate positioning the oversized stack of sheets in both sheet storing sections. Respective side guides are adjusted to account for the width of the stack 36 disposed therebetween. Once again, plate 114 is resiliently urged in an upwardly direction by spring 116 so that the uppermost sheet of stack 38 engages feed roll 106. The leading edge of the uppermost sheet is advanced from the stack by feed roll 106 into the nip defined by rolls 110 and 112. Rolls 110 and 112 continued to advance the sheet into chute 84. Chute 84 guides the sheet to the transfer station. In this way, sheet feeding apparatus 50 operates in a dual mode. In one mode, two stacks of sheets of the same or different size may be advanced therefrom. These stacks of sheets are disposed side by side on a common plate. Alternatively, an oversized stack of sheets extending from one sheet storing section into another sheet storing section may also be accommodated in the sheet feeding apparatus.

In an alternate embodiment of the present invention, one sheet feeder, for example, sheet feeder 60 may be employed in lieu of the two sheet feeders described herein. Under these circumstances, sheet feeder 60 is mounted movably in the sheet feeding apparatus. Thus, bracket 108 of sheet feeder 60 is mounted on a bar (not shown) extending in a direction substantially parallel to the sheet feed path. When sheets are being advanced from stack 68, sheet feeding apparatus 60 is disposed as shown in FIG. 2. However, when the stack of sheets located in sheet storing section 54 has been depleted, sheet feeder 60 slides on the bar into an operative position with respect to stack 76, i.e. the position shown for sheet feeder 74. In this way, sheet feeder 60 moves from one operative position associated with stack 68 to another operative position associated with stack 76. Thus, either two sheet feeders, one associated with each stack may be be utilized or, in lieu thereof, one movable sheet feeder may be employed.

In recapitulation, the sheet feeding apparatus of the present operations operates in a dual mode. In one mode of operation, sheets may be fed from either of two stack of sheets disposed side by side on a common support tray.

Alternatively, in another mode of operation, an oversized stack of sheets extending from one sheet storing section to another sheet storing station may also be accommodated and successive sheets advanced therefrom. The oversized stack of sheets is disposed on the support tray in lieu of the other stacks of sheets. In this manner, a single sheet feeding apparatus may accommodate multiple sizes of sheets.

It is, therefore, apparent that there has been provided in accordance with the present invention, a sheet feeding apparatus that fully satisfies the aims and advantages hereinbefore set forth. While this invention, has been described in conjunction with various embodiments thereof, it is evident that many alternatives, modifications and variations will be apparent to those skilled in the art. Accordingly, it is intended to embrace all such alternatives, modifications, and variations that fall within the spirit and broad scope of the appended claims.

I claim:

1. An apparatus for feeding sheet material, including:

a tray having a first sheet storing section and a second sheet storing section, said tray being adapted to support a first stack of sheet material in the first sheet storing section and a second stack of sheet material in the second sheet storing section, and, in the absence of he first stack of sheet material and the second stack of sheet material, a third stack of sheet material in the first sheet storing section with at least a portion thereof overlapping into the section sheet storing section;

a first sheet feeder adapted to be operatively associated with the first stack of sheet material or the third stack of sheet material disposed in the first sheet storing section of said tray, said first sheet feeder being in a non-operative relationship with the second stack of sheet material disposed in the second sheet storing section of said tray;

a second sheet feeder adapted to be operatively associated with the second stack of sheet material disposed in the second sheet storing section of said tray, said second sheet feeder being in a non-operative relationship with the first stack of sheet material and the third stack of sheet material, a removable partition interposed between the first sheet storing section and the second sheet storing section of said tray, said second sheet feeder being mounted on said removable partition for removal therewith from said tray when loading the third stack of sheet material therein.

2. An apparatus according to claim 1, wherein said tray includes:

a support plate, mounted movably in the first storing section, for supporting the first stack of sheets thereon; and means for moving said support plate toward said first sheet feeder to position the first stack of sheets in an operative relationship therewith.

3. An apparatus according to claim 2, wherein said moving means includes means for resiliently urging said support plate to pivot.

4. An apparatus according to claim 1, wherein said tray includes:

a support plate, mounted movably in the second storing section, for supporting the second stack of sheets thereon; and means for moving said support plate toward said second sheet feeder to position the the second stack of sheets in an operative relationship therewith.

5. An apparatus according to claim 4, wherein said moving means includes means for resiliently urging said support plate to pivot.

6. An apparatus according to claim 5, wherein said first sheet feeder includes:

a feed roll, adapted to contact an outermost sheet of the first stack of sheet material, for feeding successive outermost sheets along a sheet path; and a pair or rollers, positioned downstream of said feed roll along the sheet path, defining a nip through which the outermost sheet advanced from the first stack of sheet material passes.

7. An apparatus according to claim 5, wherein said second sheet feeder includes:

a feed roll, adapted to contact an outermost sheet of the second stack of sheet material, for feeding successive outermost sheets along a sheet path; and a pair or rollers, positioned downstream of said feed roll along the sheet path, defining a nip through which the outermost sheet advanced from the second stack of sheet material passes.

8. An apparatus according to claim 5, further including a frame slidably supporting said tray thereon.

9. A printing machine of the type in which a sheet advances to a transfer station for receiving a visible image thereat, wherein the improvement includes:

a tray having a first sheet storing section and a second sheet storing section, said tray being adapted to support a first stack of sheet material in the first sheet storing section and a second stack of sheet material in the second sheet storing section, and, in the absence of the first stack of sheet material and the second stack of sheet material, a third stack of sheet material in the first sheet storing section with at least a portion thereof overlapping into the second sheet storing section;

a first sheet feeder adapted to be operatively associated with the first stack of sheet material or the third stack of sheet material disposed in the first sheet storing section of said tray, said first sheet feeder being in a non-operative relationship with the second stack of sheet material disposed in the second sheet storing section of said tray, said first sheet feeder being adapted to advance successive outermost sheets from the first stack of sheet material or the third stack of sheet material to the transfer station;

a second sheet feeder adapted to be operatively associated with the second stack of sheet material disposed in the second sheet storing section of said try, said second sheet feeder being in a non-operative relationship with the first stack of sheet material and the third stack of sheet material, said second sheet feeder being adapted to advance successive outermost sheets from the second stack of sheet material to the transfer station; and a removable partition interposed between the first sheet storing section and the second sheet storing section of said tray, said second sheet feeder being mounted on said removable partition for removal therewith from said tray when loading the third stack of sheet material therein.

10. A printing machine according to claim 9, wherein said tray includes:

a support plate, mounted movably in the first storing section, for supporting the first stack of sheets thereon; and means for moving said support plate toward said first sheet feeder to position the first stack of sheets in an operative relationship therewith.

11. A printing machine according to claim 10, wherein said moving means includes means for resiliently urging said support plate to pivot.

12. A printing machine according to claim 9, wherein said tray includes:

a support plate, mounted movably in the second storing section, for supporting the second stack of sheets thereon; and means for moving said support plate toward said second sheet feeder to position the the second stack of sheets in an operative relationship therewith.

13. A printing machine according to claim 12, wherein said moving means includes means for resiliently urging said support plate to pivot.

14. A printing machine according to claim 13, wherein said first sheet feeder includes:

a feed roll, adapted to contact an outermost sheet of the first stack of sheet material, for feeding successive outermost sheets along a sheet path; and a pair or rollers, positioned downstream of said feed roll along the sheet path, defining a nip through which the outermost sheet advanced from the first stack of sheet material passes.

15. A printing machine according to claim 13, wherein said second sheet feeder includes:

a feed roll, adapted to contact an outermost sheet of the second stack of sheet material, for feeding successive outermost sheets along a sheet path; and a pair or rollers, positioned downstream of said feed roll along the sheet path, defining a nip through which the outermost sheet advanced from the second stack of sheet material passes.

16. A printing machine according to claim 13, further including a frame slidably supporting said tray thereon.

* * * * *